United States Patent [19]

Korman

[11] 3,984,168

[45] Oct. 5, 1976

[54] LOCK FOR INSULATED CORD GRIP

[75] Inventor: Melvin Korman, North Attleboro, Mass.

[73] Assignee: General Electric Company, New York, N.Y.

[22] Filed: Apr. 29, 1975

[21] Appl. No.: 572,771

[52] U.S. Cl. ..... 339/103 C; 339/139 C; 339/209

[51] Int. Cl.[2] ..... H01R 13/58

[58] Field of Search ..... 339/103 R, 103 B, 103 C, 339/105, 107, 139 C, 209

[56] References Cited

UNITED STATES PATENTS

| | | | |
|---|---|---|---|
| 2,089,844 | 8/1937 | Anderson | 339/103 C X |
| 3,500,286 | 3/1970 | Carlson et al. | 339/139 C |

*Primary Examiner*—Roy Lake
*Assistant Examiner*—DeWalden W. Jones
*Attorney, Agent, or Firm*—Paul E. Rochford; Walter C. Bernkopf

[57] ABSTRACT

An insulating cord grip capable of being locked and unlocked by hand includes two cylindrical sections each having a hand grip on its outer surface. A locking of one of the sections relative to the other is achieved through relative rotary motion about a common axis to move one section axially with respect to the other. The locking means include a locking thread on the inner surface of one section and one on the outer surface of the other section. The two sections cooperate as they are rotated relative to one another with an internal cable clamping member which member tends to urge the sections apart axially with increasing force as the axial approach of the two sections urges the clamp against a contained cable with increasing force.

4 Claims, 8 Drawing Figures

LOCK FOR INSULATED CORD GRIP

RELATED APPLICATIONS

This application relates to applications Ser. No. 572,794 of Robert Maloof and Luther Sheldon filed Apr. 29, 1975, Ser. No. 462,067 of Melvin Korman and Luther Sheldon filed Apr. 18, 1974, and Ser. No. 572,793 of Fred Nelson filed Apr. 29, 1975, all of which are owned by the same assignee as this application.

BACKGROUND

The present invention relates to a hand grip operated cord clamp for wiring devices and particularly which includes means for attachment of a hand grip to a wiring device in which electric conductors of a cable are secured and to a clamp associated with the grip for providing a strain relief clamping of the cable.

It is well known that caps and connectors are the common designation of wiring devices which are employed to provide terminals to cables which carry power from power sources to apparatus in which the power may be utilized. Such caps and connectors include means for fastening the conductors of cables to electric contacts of the caps and connectors and includes means for gripping the cable at its insulation adjoining the end of the cable from which the conductor extends into the cap or connector.

A U.S. Pat. No. 3,461,417 issued to the same assignee as this application discloses the structure of such a cap and connector and the metal clamp structure associated with the cap and connector for strain relief gripping of the cable end by its insulation. The cable clamps of such caps and connectors do not serve as convenient hand grips for the hand manipulation of the devices in making connection or disconnection between such devices.

There is a form of cap which is equipped with a set of straight blades and these straight blades are inserted into straight blade receptacle in a matching connector. Such a cap is disclosed in U.S. Pat. No. 3,624,591 and another form is disclosed in U.S. Pat. No. 3,744,008.

There is another form of cap which is equipped with so-called locking blades and use of such caps and connectors together involves an insertion of the blades into respective matching blade ports in the connector and the turning of the cap relative to the connector in order to lock the locking blades in place in the connector. Similarly, when the locked cap and connector are to be disengaged, the first motion which must be imparted to the cap relative to the connector is a turning motion opposite from the turning motion which locks the blades in place. This is followed by a pulling motion to remove the blades of the cap from the blade receptacles of the connector. A hand grip which is used in connection with such locking caps and connectors is therefore subjected to a rotary motion as part of the locking and also as part of the unlocking of the blades during the normal use and operation of such locking caps and connectors.

Based on simple caution in use of such electrical devices, it would not appear feasible to employ a cable clamp for a wiring device which operated by the turning of a hand grip where the operation of the wiring device as a cap or connector required the imparting of a turning motion to the same hand grip. In other words, it would not appear feasible to make a cable clamp operate by hand turning activation of the clamp where the turning motion applied to the hand grip portion of a cap or connector was the same motion applied to the same hand grip portion of the device which was necessary to operate the wiring device in breaking the locking connection with another wiring device. More conventional caps and connectors such as those disclosed in U.S. Pat. Nos. 3,605,059 and 3,457,980 do not employ cable clamps which are operated by application of a torsional force to the grip of the device itself.

It is somewhat surprising that it has been found possible to construct a device which provides a calmp about the cable to effectively lock the cable to the wiring device, and to provide a strain relief for any strain that is placed on the cable, by a torsional or twisting motion which is essentially the same twisting motion which is applied to the device as a whole when bringing them into their locked and unlocked positions.

In other words, it has been found that use may be made of a twisting motion to clamp a cord clamp by hand onto a cord and that use may be made of a reverse twisting motion in releasing the clamp from the cord where both motions are imparted by use of hand grip on the respective clamps. What is surprising is that this hand twisting of the clamp element can be successfully used in the clamping and unclamping while the hand twisting of the connector is employed in connecting and disconnecting the cap and connector from each other.

What is surprising is that although one might normally expect that it would be improvident based on safety consideration to construct a cord clamp for a cap and connector where the cord clamp itself is operated by a hand twisting motion to engage the cable in the clamp and also to disengage the cable from the clamp it has now been found that this can be done and that the clamp so constructed is highly effective for its purpose. This is contrary to the teaching for example of U.S. Pat. No. 3,865,461 which includes a ratchet and locking pawl to prevent undoing of the device during handling even where locking blades are not involved. A patent such as the Santologo patent shows tool flats indicating the need for tools in manipulating the device.

OBJECTS OF THE INVENTION

It is accordingly one object of the present invention to provide a hand activated cable clamp for a cap and connector which is clamped or released to a cable by a hand imparted rotary motion.

Another object is to provide a means for securing a cable clamp in place rapidly and securely.

Another object is to provide a cable clamp capable of being quickly clamped to a cable and also being capable of being quickly disconnected from a cable using hand activation.

Another object is to provide a cable clamp which has a comfortable hand grip which hand grip serves both for the unlocking of wiring devices relative to one another and for connecting and disconnecting the clamp from the cable passing therethrough.

Another object is to provide a hand activated cable clamp which has small overall dimensions because of an axial activation of the clamping components to provide secure clamping of the clamp portion of a wiring device about a cable passing therethrough.

Another object is to provide a cable clamp which can be operated without any special tools in engaging the cable within the cable clamp or in disengaging it from the cable clamp.

Another object is to provide a mechanism by which a cable can be rapidly and securely clamped and which has no metal parts operating against the hands of the user or against the surface of the cable.

Another object of the invention is to provide a cable clamp which operates by hand motion so that the user will know from the feel of the clamping mechanism that a secure grip has been formed by the clamp on the cable passing therethrough.

Other objects and advantages of the present invention will be in part pointed out and in part apparent from the description which follows.

SUMMARY OF THE INVENTION

A locking clamp for a cap or connector is made up of two tubular parts. A first tubular part has two longitudinal portions, the first portion having an external gripping surface and having within the first portion means for attachment of the clamp to a wire terminal. The second portion of the first tubular part has an external threaded surface and has internally means for activating a clamping means. The second tubular part of the clamp mechanism has an external hand gripping surface and has internal threads which engage the threads of the second portion of the first tubular part. The first and second parts also have internally thereof a clamping mechanism contained within and activated by the two tubular parts. The clamping mechanism is actuated by relative rotary motion of the two parts to develop a clamping pressure against the contained cable and also tending to resist axial movement of the two parts together. The cable gripping means urges the two axially aligned tubular parts away from each other with greater force as the cable gripping element is urged with greater force against a cable. The threads of the two threaded portions are of the self-locking variety and the threads develop greater locking force therebetween as the operation of the locking clamp induces greater axially outward exertion between the two sets of threads.

DESCRIPTION OF THE FIGURES

The detailed description of the invention which follows will be better understood by reference to the accompanying drawings in which.

DESCRIPTION OF THE PREFERRED EMBODIMENT

Figure 1:
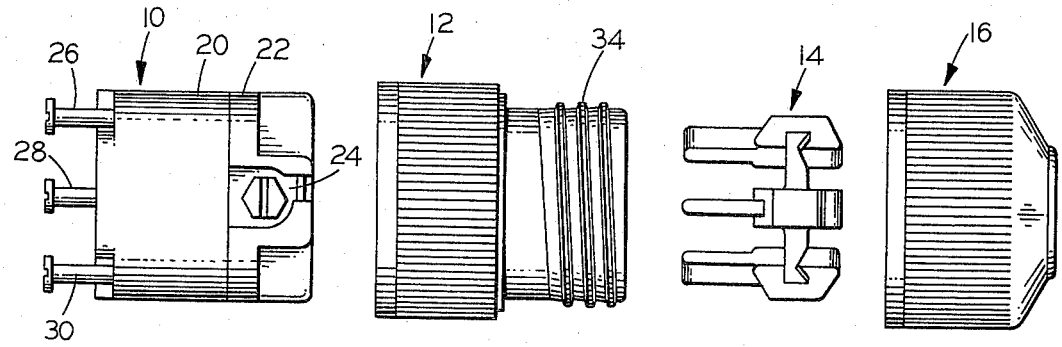
FIG. 1 is an exploded side elevational view of cable connector elements as provided pursuant to this invention.

A connector as provided pursuant to this invention includes a connector body in which blade contacts and wire terminals are housed, and also includes a clamp for the cable to be attached to the connector body to provide a strain relief grip on the cable extending through the clamp and to the connector body. Such a device is illustrated in exploded form in FIG. 1 where the connector body 10 is seen at the left hand side and the elements 12, 14, and 16 of the clamp are illustrated on the right hand side. The connector is made up of a blade contact housing 20 and a wire terminal housing 22. The connector body 10 is an insulating housing made of molded plastic and it contains metal parts only one of which, 24, is evident in FIG. 1. The connector body 10 is attached to the base 12 of the cable clamp by threading the fasteners 26, 28, and 30 into matching holes in the interior surface of the base 12.

The band of double wedges 14 rests in the upper portion of the base 12 in contact with ramps built integrally with the base 12 internally thereof. The cover 16 has a beveled back surface 32 which surface acts against the wedges of the band 14 to urge the double wedges along the ramps within base 12 and to position them against a cable extending through the clamp portion of the overall connector.

Figure 2:
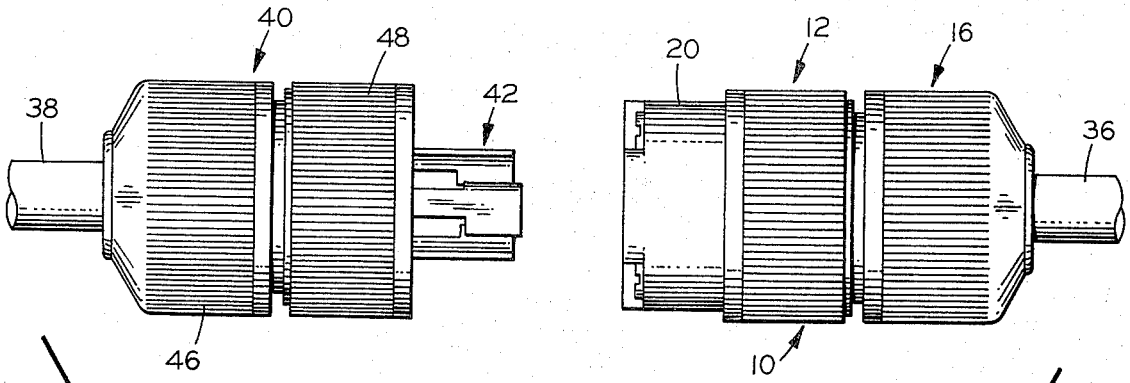
FIG. 2 is a side elevational view of a locking cap and connector poised for assembly and locking together.

Once the connector has been joined to a cable and the clamp portion has been duely clamped about the cable and attached to the connector housing 10, the overall device appears as shown on the right hand side of FIG. 2.

It should be emphasized that in assembling the cable clamp together and in forming a calmping attachment about a cable extending through the cable clamp to the connector body, the base 12 and cover 16 are rotated relative to one another to thread an internal thread on the internal surface of cover 16 onto the external thread 34 shown on the external surface of base 12. Accordingly, in forming the clamping action of clamp elements on a cable extending therethrough a motion is employed to rotate the cover 16 by hand grip contact with the cover relative to the base 12. A hand grip contact pressure is maintained on the knurled external surface of the base 12 during the clamping. This turning of the cover 16 relative to the base 12 as well as the reverse turning of the cover 16 relative to the base 12 in disassembling the clamp are motions which are essentially the same as the motions which are employed in the use of the cap and connector in forming locking contact with other devices. This is more readily evident from a consideration of the content of FIG. 2.

In FIG. 2 a connector in essentially a fully assembled form is illustrated at the right hand side of the figure and this connector is fully connected to and mounted about the end of a cable 36. Standing opposite the connector and deployed on the left hand side of the figure, a cap 40 having a set of blades 42 and having a cable 38 extending from the left end of the cap is positioned to be connected with the connector and particularly to have the blades 42 enter the contact housing 20 of connector body 10. It should be noted that the cable clamp of the cap 40 on the left is in all essentials the same as the cable clamp of the connector on the right. Its attachment to the cable 38 is accomplished as described above with reference to the cable clamp of the connector of FIG. 1.

Because the blades 42 of cap 40 are of the locking variety, the simple insertion of these blades into the contact housing 20 is not sufficient to make the so-called locking connection between this cap and connector. Rather, what is necessary is that the cap and connector be turned relative to each other to move the blades of the cap into a locked position with respect to the contacts within the contact housing of the connector body and also with respect to the blade openings provided in the face of the connector body confronting the blades 42 of the cap. This relative rotation of the cap and of the connector can have the effect of locking the locking blades in place in the connector body and accordingly preventing the separation of the cap and connector when a simple pull is exerted along the lengths of the attached cables 36 and 38. It also can have the effect of re-enforcing the clamping of the cable clamp on the respective cables 36 and 38. The reason for this latter effect is that the cable clamps themselves are subject to operation by a hand turning of one portion of the cable clamp relative to the other. In other words, if the respective cover portions alone of the cable clamps of the cap and of the connector are turned clockwise relative to each other, there is a re-enforcement of the clamping action of the cable clamp on the cable as this clockwise relative turning has the effect of tightening the respective clamps.

Conversely, when the locking connection between the blades and the contacts within the connector body 10 are to be detached and disconnected, the first force and motion which is imparted to the cap and connector is a reverse torsion and reverse rotary motion which is imparted by hand to the hand-held portions of the respective cap and connector. This motion may very well be a motion imparted essentially in its entirety to the respective covers of the cap and of the connector. Accordingly, where such counter-clockwise motion and rotary force is applied to the respective cap and connector, there is a tendency not only to disengage the blades 42 from the contacts within connector body 10, but there is in addition a tendency to unclamp the clamp member of the respective cap and connector from the ends of the cables 38 and 36.

Accordingly, if the cap 40 is gripped only by the cover 46 of the cable clamp thereof and the connector is gripped only by the cover 16 of the cable clamp thereof and these respective covers 46 and 16 are given a reverse twist or a counter-clockwise twist so as to unlock the blade 42 from their respective locked position in the connector body 10, the unlocking of the blades must and can in accordance with this invention be accomplished effectively without the loosening or disconnecting or unclamping the respective clamps of the cap and connector. This effect is obtainable pursuant to this invention even though the reverse twist of the cover with reference to the base of each of the cable clamps of the devices is the motion which accomplishes an unclamping of the cable clamp from the cable passing therethrough.

Figure 3:
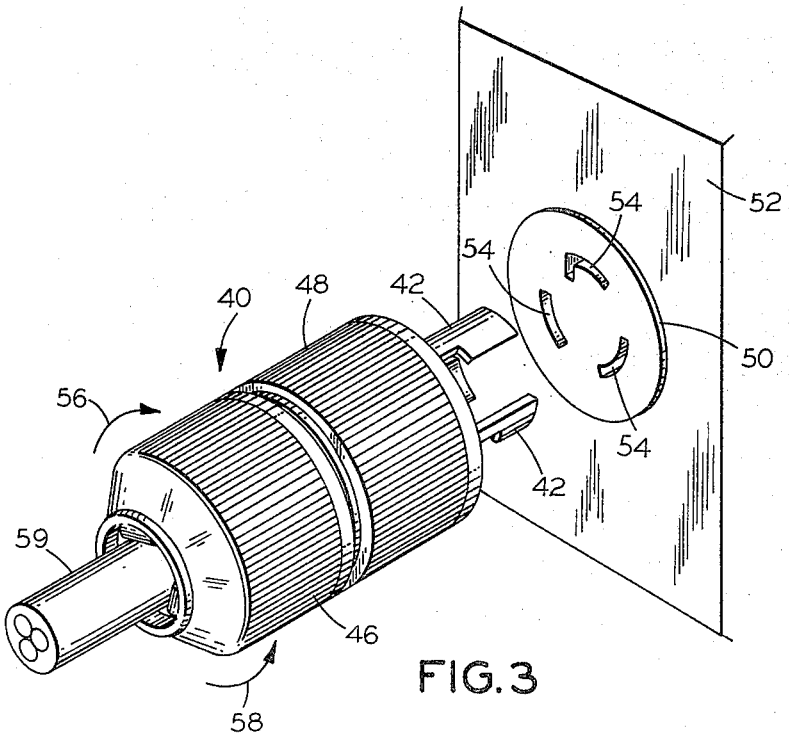
FIG. 3 is a perspective view of a locking cap poised for entry into a locking wall receptacle.

Similarly, with reference to FIG. 3, the cap 40 having a cover 46, a set of blades 42, and a clamp base 48 is connected into a wall receptacle having a central connector body 50 and having a wall plate 52 surrounding the connector body. In actual application the blades 42 of cap 40 may be inserted into the blade receptacles 54 in the connector body 50 of the wall receptacle and the cap may be secured or locked therein by a clockwise twist indicated by arrow 56 to secure the blades in locking relation within the connector 50 and to ensure good electrical contact of the blades 42 with the contacts within connector body 50.

Conversely, when the cap is to be removed from the wall receptacle the cap is given a reverse or counter-clockwise twist indicated by arrow 58 and the blades are unlocked from their captive position within the blade ports 54 and they may then be withdrawn by a simple pull. In fact it has been found that if the cover 46 is the only part of the cap which is gripped during this latter operation, it is possible to disengage the blades from their captive position and to disconnect the plug from the wall receptacle without disconnecting or loosening the cable clamp itself from its firm strain relief grip on cable 59. The unique capability of the cable clamp to be used as a handle and grip in manipulating the cap and connector through its locking and through unlocking operations is a unique property of the article of the present invention. Other devices of similar but not the same capability are known in the art. As for example, a cap is taught in the U.S. Pat. No. 3,624,591 wherein it is taught that a cord clamp can be operated by a hand grip rotary motion of two cable clamp elements, but in this case the blades employed in combination with the cable clamp are straight blades and are employed in making or breaking connections solely by the pulling or pushing of the cap by its cable clamp into or out of connection with an appropriate wall receptacle or other receptacle.

Figure 4:
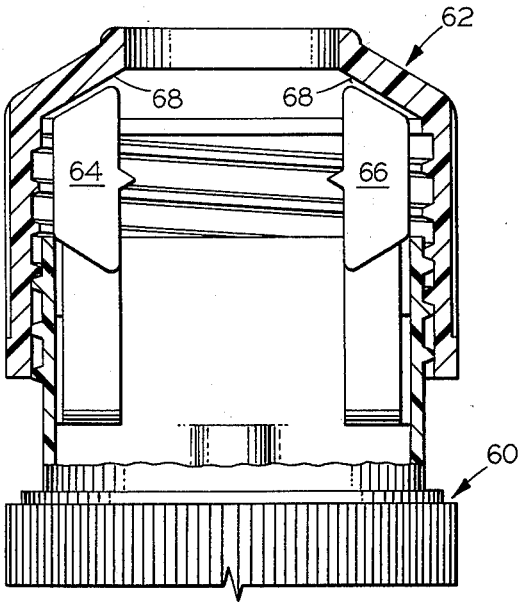
FIG. 4 is a vertical section essentially through the axis of the clamp portion of the connector and illustrating arrangements of parts thereof.
Figure 5:
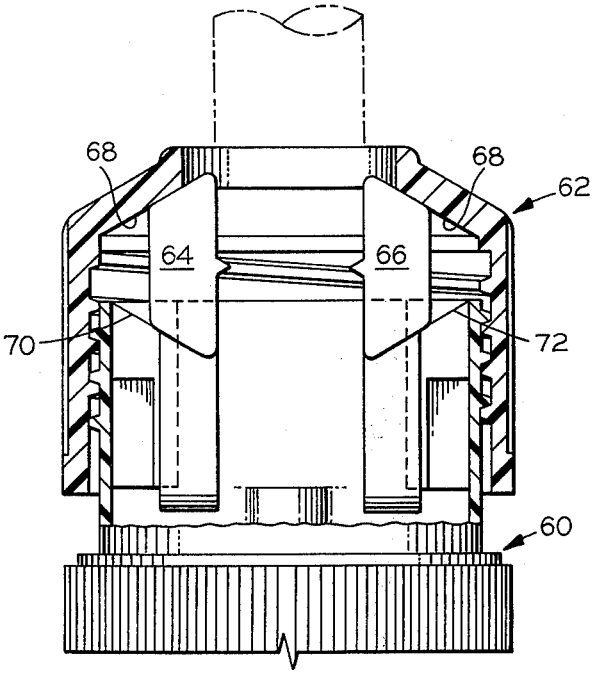
FIG. 5 is a view similar to that of FIG. 4 after the cord clamp has been brought to bear against and to grip a cable.

A particular mechanism by which the unique performance of the cap and connector of this invention may be achieved is by a special thread which is positioned on the external surface of the base of the cable clamp and on the internal surface of the cover of the cable clamp. Thus as is evident from FIGS. 1, 4, and 5, the external surface of the upper portion of the base element of the connector 60 is threaded on its external surface. From FIGS. 4 and 5 it is evident that the cover 62 of the cable clamp is threaded on its internal surface facing the externally threaded surface of base 60. Accordingly, as the cover 62 is turned in a clockwise direction relative to base 60, the threads engage and cause the cover to move downward. The double wedges 64 and 66 mounted on a pliable band (not shown) operate on internal ramps 70 and 72 formed integrally with the base 60 of the cable clamp. Also, the double wedges operate in concert with the beveled inner surface 68 of the cover 62 of the cable clamp. The pliable band on which the double wedges are supported tends to separate the double wedges within the cable clamp enclosure as illustrated in FIG. 4. However, as the cover 62 is turned in a clockwise direction relative to the base 60, the beveled surface 68 bears on the upper surface of the double wedges 64 and 66 and causes it to move inward toward a gripping position with reference to a cable. In FIG. 5 the double wedges 64 and 66 are shown to have moved inward under the influence of the descending cover 62. They are shown in a position where they may come into contact with and form a grip on the cable (shown in phantom) positioned therebetween. While the FIGS. 4 and 5 are shown somewhat schematically to illustrate the operation of the device, it will be understood that the number of double wedges need not be limited to two, but can be three or more as illustrated in FIG. 1 of the drawing.

Figure 6:
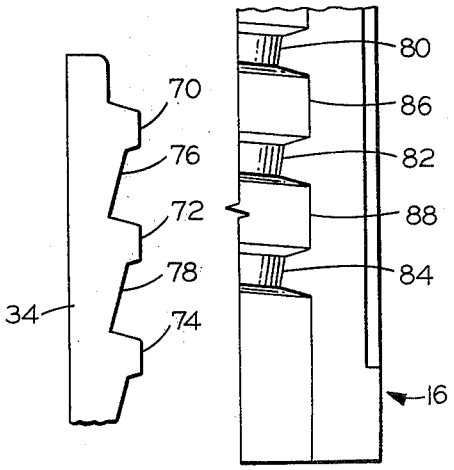
FIG. 6 is an enlarged detailed view of the threads employed in the article of FIGS. 1 through 5.

The special thread employed in forming the tight grip of the cover 62 on the base 60 is illustrated in FIG. 6. This type of thread is known in the art as a Dartelet type thread and its general structure, use, and function have been known for many years. For example, a description of this type of thread is given in a text written by Thomas E. French and reused by Charles J. Vierck, *A Manual of Engineering Drawing for Draftsmen*, Seventh Edition 1947, published by Mc Graw Hill Book Company. While this thread as taught in this book is generally known to be used for threads in metal materials, it has been found that it can be employed successfully in certain plastic materials. For example, it has been found that the 6° angle shown in the above reference as the angle of taper of confronting surfaces is inadequate and that a larger angle of the order of 15° is needed for successful operation of self-locking plastic clamp mechanism.

The forms of the threads as they are illustrated in FIGS. 4 and 5 are essentially schematic in form and do not accurately represent the cross-sectional form of the individual threads as actually employed in the devices of this invention. A more accurate representation of the form of thread is given in FIG. 6 where a thread bearing external wall 34 of the base 12 is shown in vertical section. Section marks are omitted in order to avoid an unnecessary confusion of the figure which results from the presence of the cross-section hatching. The wall 34 is provided with outwardly extending threads 70, 71, and 72, and between these threads is located a beveled well surface 76 and 78. These beveled well surfaces are wider than the threads 80, 82, and 84 on the internal surface of the cover 16. The threads 82, 84, and 86 are separated by wells 86, and 88 which are also wider than the threads 70, 72, and 74 on the inner threaded wall 34.

The operation of the thread incoporated in the cap and connector combinations of this invention is similar to the operation of Dardalet threads of other mechanisms. In the combination of this invention, however, the operator of the cable clamp and of the cap and connector incorporating the cable clamp is given and has a sense of "feel" of the mechanism and can use this sense of feel in dealing with and utilizing the mechanisms of this invention. The party employing the mechanisms must first connect the wire to the contact housing and then attach the clamp mechanism and then secure the clamp mechanism firmly on the cable. This party can feel the firmness with which the grip is established by the resistance of the clamp to turn beyond the point where a firm grip is established.

Figure 7:
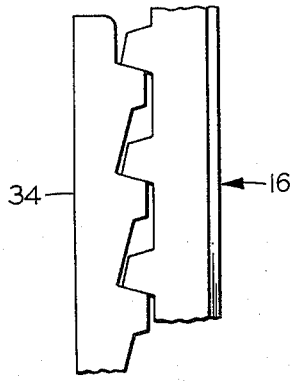
FIG. 7 is a schematic view similar to that of FIG. 6, but showing the threads meshed in the unlocked position.
Figure 8:
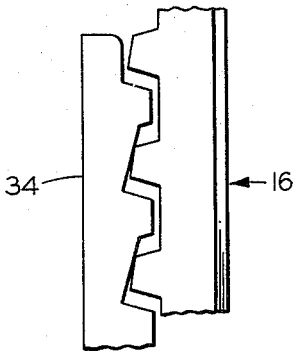
FIG. 8 is a view similar to that of FIG. 7, but illustrating the meshed threads in a locked position.

The way in which this works is illustrated again schematically in FIGS. 7 and 8. In FIG. 7 the threads are shown in the position in which they are situated relative to each other before the clamp has been tightened on the cable. In the position shown the thread 84 sits at the bottom of well 78 as the outer cover element 16 and is free to rotate in well 78. Turning cover 16 relative to base 12 is accomplished with low resistance because the individual threads are free to turn in their respective wells.

However, as the clamping double wedges 64 and 66 are moved inward response to relative turning of cover 16 and base 12 there is a resultant force developed tending to separate cover and base. As a result, a thread such as 84 rides up in its well 78 and the confronting surfaces on the outer surface of the thread and on the inner surface of the well make contact. As the angles on these confronting surfaces are set at values which cause the surfaces to form a press fit and to bind the resistance to turning of the cover relative to the base increases and can be felt in the hands of the user who is tightening the clamp. Increased tightening generates increased binding of the confronting thread and well surfaces and this in turn means more secure clamping of the cable in the clamp mechanism. It has been found in fact that by appropriate increase in the angles of the confronting surfaces and the other measures taught herein that a very secure locking of the clamp mechanism on a cable is achieved even though the cap and connector are of a locking variety and even though the normal use of the locking cap and connector requires a reverse twist in disconnecting the cap and connector which reverse twist is essentially the same as the reverse twist applied to cover 16 in disconnecting it from base 12.

Surprisingly, it has been found that once the binding of the threads has been accomplished, there is a disproportionately large force needed to unscrew and release the clamp and that the device is in this respect analagous to a collet in its actual operation.

The two tubular parts 12 and 16 of the device may be made of the same or of different plastic materials to enhance the gripping and release properties of the confronting thread surfaces relative to one another. Some materials such as the polycarbonate plastics have poor surface binding properties and tend to gall. Other materials such as the nylons have high lubricity and tend to expand the walls of the cover 16 as tightening is increased. A preferred material is an alloy of ABS plastic with polyvinylchloride as this has a good balance of lubricity and binding properties.

I claim:

1. A locking electrical connector comprising a cable terminal and a cable clamp, said cable terminal having an insulating housing and having conductive conductor terminal means within the housing, and said terminal having locking contacts extending from said conductor attachment terminals, said clamp and terminal being adapted to be and having means for being assembled together after cable conductors are connected to said conductor terminals, said clamp being made up of two insulating tubular parts having internal wedge means for bearing against a cable passing therethrough, a first tubular part having an external hand gripping surface at one section thereof and having an external thread at another section thereof, a second tubular part having an external hand gripping surface and having an internal thread, said internal wedge means being free to move generally radially in said tubular parts into and out of contact with a cable passing through said clamp, means for inducing radial movement of said wedge means responsive to axial movement of said two tubular parts, said two tubular parts being movable axially responsive to the engagement of said internal and external threads and rotation of said tubular parts relative to each other, and the threads of said tubular parts being of the self-locking Dardalet type.

2. The article of claim 1 wherein the tubular parts are plastic.

3. The article of claim 1 wherein the angle of the Dardalet type threads is of the order of 12 to 15°.

4. The article of claim 2 wherein the plastic has a good balance of lubricity and surface binding properties.

* * * * *